US005813312A

United States Patent [19]

Arai et al.

[11] Patent Number: 5,813,312

[45] Date of Patent: Sep. 29, 1998

[54] HYDRAULIC CONTROL APPARATUS

[75] Inventors: Seigo Arai; Takahiro Kobayashi, both of Akashi, Japan

[73] Assignee: Kabushiki Kaisha Kobe Seiko Sho, Kobe, Japan

[21] Appl. No.: 653,300

[22] Filed: May 24, 1996

[30] Foreign Application Priority Data

May 24, 1995 [JP] Japan ..... 7-125335
Jul. 24, 1995 [JP] Japan ..... 7-187232

[51] Int. Cl.[6] ..... F15B 11/042

[52] U.S. Cl. ..... 91/516; 91/517; 60/422

[58] Field of Search ..... 60/421, 422; 91/516, 91/517

[56] References Cited

U.S. PATENT DOCUMENTS

| | | | |
|---|---|---|---|
| 3,032,994 | 5/1962 | Lindell | 60/421 |
| 3,971,216 | 7/1976 | Miller | 91/518 |
| 4,024,710 | 5/1977 | Zelle | 60/422 |
| 4,161,256 | 7/1979 | Seaberg . | |
| 4,345,436 | 8/1982 | Johnson | 60/421 |
| 4,473,090 | 9/1984 | Uehara et al. | 60/421 |
| 4,508,013 | 4/1985 | Barbagli . | |
| 4,977,928 | 12/1990 | Smith et al. . | |
| 5,083,428 | 1/1992 | Kubomoto et al. | 60/422 |

FOREIGN PATENT DOCUMENTS

| | | |
|---|---|---|
| 0 393 195 | 10/1990 | European Pat. Off. . |
| WO 91/11622 | 8/1991 | WIPO . |
| WO 94/10455 | 5/1994 | WIPO . |

OTHER PUBLICATIONS

Patent Abstracts of Japan, vol. 12, No. 454, (M–769), Nov. 29, 1988, JP–63–181822, Jul. 27,1988.

*Primary Examiner*—F. Daniel Lopez
*Attorney, Agent, or Firm*—Oblon, Spivak, McClelland, Maier & Neustadt, P.C.

[57] ABSTRACT

A hydraulic control apparatus having two groups and formed by combination of actuator circuits on large flow rate side (a boom cylinder circuit and an arm cylinder circuit) and actuator circuits on small flow rate side (a bucket cylinder circuit and a rotating motor circuit), for independent supply of hydraulic fluid. In these groups, a bucket preferential valve and a rotating preferential valve form bucket cylinder preferential and rotating motor preferential circuit constitutions.

8 Claims, 4 Drawing Sheets

HYDRAULIC CONTROL APPARATUS

BACKGROUND OF THE INVENTION

The present invention relates to a hydraulic control apparatus used in a hydraulic working machine such as a hydraulic excavator in which a plurality of actuators are simultaneously driven (combined control).

A prior art hydraulic excavator will be explained as an example.

The most common hydraulic control apparatus of the hydraulic excavator is constituted as shown in FIG. 1.

In the drawing, A denotes a boom cylinder circuit which actuates a boom cylinder 1 for raising and lowering a boom; B, a bucket cylinder 2 for driving a bucket; C, a rotating motor circuit for driving a rotating motor 3 to rotate an upper body; and D, an arm cylinder circuit for driving an arm cylinder 4 to operate an arm. These circuits (hereinafter generically termed the actuator circuit) A, B, C, and D are parallelly connected to one hydraulic pump 5.

The actuator circuits A to D are provided with hydraulic pilot valves 6, 7, 8 and 9, which are operated by means of a remote-control valve (not shown) to control the operation of each actuator.

Also, the actuator circuits A to D are provided with pressure-compensating flow control valves 10, which divide the flow of the hydraulic fluid in order to acquire a required flow rate.

Furthermore, a hydraulic pilot type pressure compensating valve 11 is provided on the pump delivery side, so that pump pressure compensation control is performed to correct the pump delivery pressure to a value over the maximum value of a pressure (load pressure) required by each actuator when the combined control is made for simultaneously driving a plurality of actuators.

A reference numeral 12 denotes a regulator which controls the pump delivery flow rate in accordance with the pump delivery pressure, and 13 refers to a shuttle valve (a high-pressure selection valve) for selecting the maximum load pressure.

According to a conventional load sensing type hydraulic control apparatus using the pressure-compensating flow control valve 10, the actuators 1 to 4 can be operated at a flow rate, or a speed, corresponding to the amount of control of the control valves 6 to 9 without being affected by the load pressure of other actuators during the combined control.

In the meantime, when the pump delivery flow rate is exceeded by the sum of required flow rate (gross flow rate required) produced by the operation of the control valves 6 to 9, the hydraulic fluid discharged from the pump flows into one actuator circuit where the load pressure is low; accordingly an insufficient flow rate occurs on the other actuator circuit where the load pressure is high, and an expected function of pressure compensation can not be obtained, resulting in occurrence of such a phenomenon (saturation) that the actuator operates at an excessively slow speed and sometimes stops.

For the purpose of preventing this saturation, the prior art apparatus adopts a proportional allocation system which allocates pump delivery flow rate at a required ratio of flow rate of each actuator circuit in accordance with the amount of valve operation as disclosed in Japanese Patent Publication No. Hei 6-68281.

Concretely speaking, as shown in FIG. 4, the amount of operation PB1, PB2, Pb1, Pb2, Ps1, Ps2, Pa1 and Pa2 (pilot pressure) of the control valves 6 to 9 are sensed by unillustrated sensors and inputted as electrical signals to a controller 14; and when the gross required flow rate exceeds the pump delivery flow rate, signals Pi1, Pi2, Pi3 and Pi4 are outputted from the controller 14 to each flow control valve 10 via solenoid proportional valves 15 to decrease the flow rate by the proportional allocation.

The above-described constitution, however, has the following problems.

(1) Problem on the constitution of control system

The actuator circuits A, B, C and D require the use of the pressure compensating flow control valve 10. Because a command for decreasing the flow rate is produced from the controller 14 to the flow control valve 10 on the basis of the gross required flow rate and the pump delivery flow rate, the control system becomes complicated in constitution, thereby making the whole constitution of the apparatus complicated and increasing a cost.

Problem on function

In the case of a hydraulic excavator, there is a difference in the flow rate (operating speed) and working pressure required by the actuators 1 to 4 in general excavating operation.

That is, as regards the required flow rate, the boom cylinder 1 and the arm cylinder 4 require large flow rates, while the bucket cylinder 2 and the rotating motor 3 requires small flow rates.

In the meantime, as regards the pressure, the boom cylinder 1 and the rotating motor 3 requires high pressures, while the bucket cylinder 2 and the arm cylinder 4 requires low pressures.

In the prior art apparatus, to prevent the saturation stated above, the supply flow rate is determined by the proportional allocation based on the amount of valve operation regardless of the required flow rate and the amount of required pressure by each actuator; therefore (a) the supply flow rate to the actuators requiring the small flow rate is further decreased by the proportional allocation, resulting in failure of holding the minimum flow rate required for operating the actuator, accordingly in an extremely lowered working speed, and in inefficient operation.

(b) The flow rate required by the amount of valve operation is not necessarily the same as the flow rate actually required. For example, the upper rotating body, having a great inertia, requires a high pressure but a small flow rate during the initial period of rotating motion from actual start to a steady operation.

That is, though a large flow rate is demanded at the start of the rotating motion, the flow rate actually absorbed by the rotating motor 3 is little; most of the flow rate becomes an excess fluid, which is discarded to a tank through a relief valve. That is, the fluid is wasted.

SUMMARY OF THE INVENTION

It is, therefore, an object of the present invention to provide a hydraulic control apparatus which is capable of supplying a hydraulic fluid at a proper flow rate to each actuator at the time of combine control when the gross required flow rate exceeds the pump delivery flow rate.

It is another object of the present invention to provide a hydraulic control apparatus which is of a simple constitution and low in cost.

In the hydraulic control apparatus according to the preferred embodiment of the present invention, provided are a hydraulic pressure source, a first group including a combination of an actuator circuit on the large flow rate side which requires a large flow rate and an actuator circuit on the small flow rate side which requires a small flow rate, a second group including a combination of an actuator circuit on the large flow rate side which requires a large flow rate and an actuator circuit on the small flow rate side which requires a small flow rate, the second group being connected to the hydraulic pressure source independently in pressure of the first group, and a preferential valve provided in each of the first group and the second group, the preferential valve being designed to supply a pressure fluid preferentially to the actuator circuit on the small flow rate side when the actuator circuit on the large flow rate side and the actuator circuit on the small flow rate side of each group are simultaneously operated.

The hydraulic control apparatus of the present invention is suitably adapted to a hydraulic excavator. More preferably, it may also have a tank for receiving excess fluid from the first group and the second group, an unloading circuit provided to return the excess fluid into the tank, and a confluent line connected to the unloading circuit, to supply excess fluid from the other group to the actuator circuit on the large flow rate side within one group in accordance with a demand of the actuator circuit on the large flow rate side within one of the groups.

A group may be formed by the combination of the actuator on the high pressure side and the actuator on the low pressure side. In this case, a preferential valve preferentially supplies the fluid to the actuator circuit on the high pressure side.

According to the present invention, the hydraulic fluid is supplied preferentially to the actuator circuit on the small flow rate side at the time of combined control in the two groups formed by combining the actuator circuit on the large flow rate side and the actuator circuit on the small flow rate side. Therefore, at the time of combine control when the gross required flow rate exceeds the pump delivery flow rate, a required flow rate is secured at the actuator on the small flow rate side and also a substantial amount of excess fluid is supplied to the actuator on the large flow rate side, thus enabling to ensure its operation.

Furthermore, when the fluid is demanded by the actuator circuit on the large flow rate side of one group and an excess amount of fluid is present in the other group, the excess fluid is supplied to the actuator circuit on the large flow rate side by the confluent line. Therefore it is possible to secure a substantial quantity of fluid at the time of combined control thus improving combined control performance.

As another embodiment of the present invention, a group may be formed by the combination of the actuator on the high pressure side and the actuator on the low pressure side. In this case, a preferential valve preferentially supplies the fluid to the actuator circuit on the high pressure side.

In this case, the hydraulic fluid is supplied preferentially to the actuator circuit on the high pressure side, at the time of combined control in the two groups formed by combining the actuator circuits on the high pressure side and the actuator circuits on the low pressure side. Therefore, at the time of combine control when the gross required flow rate exceeds the pump delivery flow rate, a required flow rate is supplied to the actuator on the high pressure side, while all the remaining fluid is supplied to the actuator on the low pressure side. It is, therefore, possible to ensure the operation of the actuator on the high pressure side where the fluid is hard to flow, and also to prevent wasting the fluid as in the case of the circuit constitution in which all the excess fluid is returned to the tank.

DESCRIPTION OF THE PREFERRED EMBODIMENTS

Preferred embodiments of a hydraulic control apparatus according to the present invention will be explained with reference to FIGS. 1 to 3.

Figure 4:
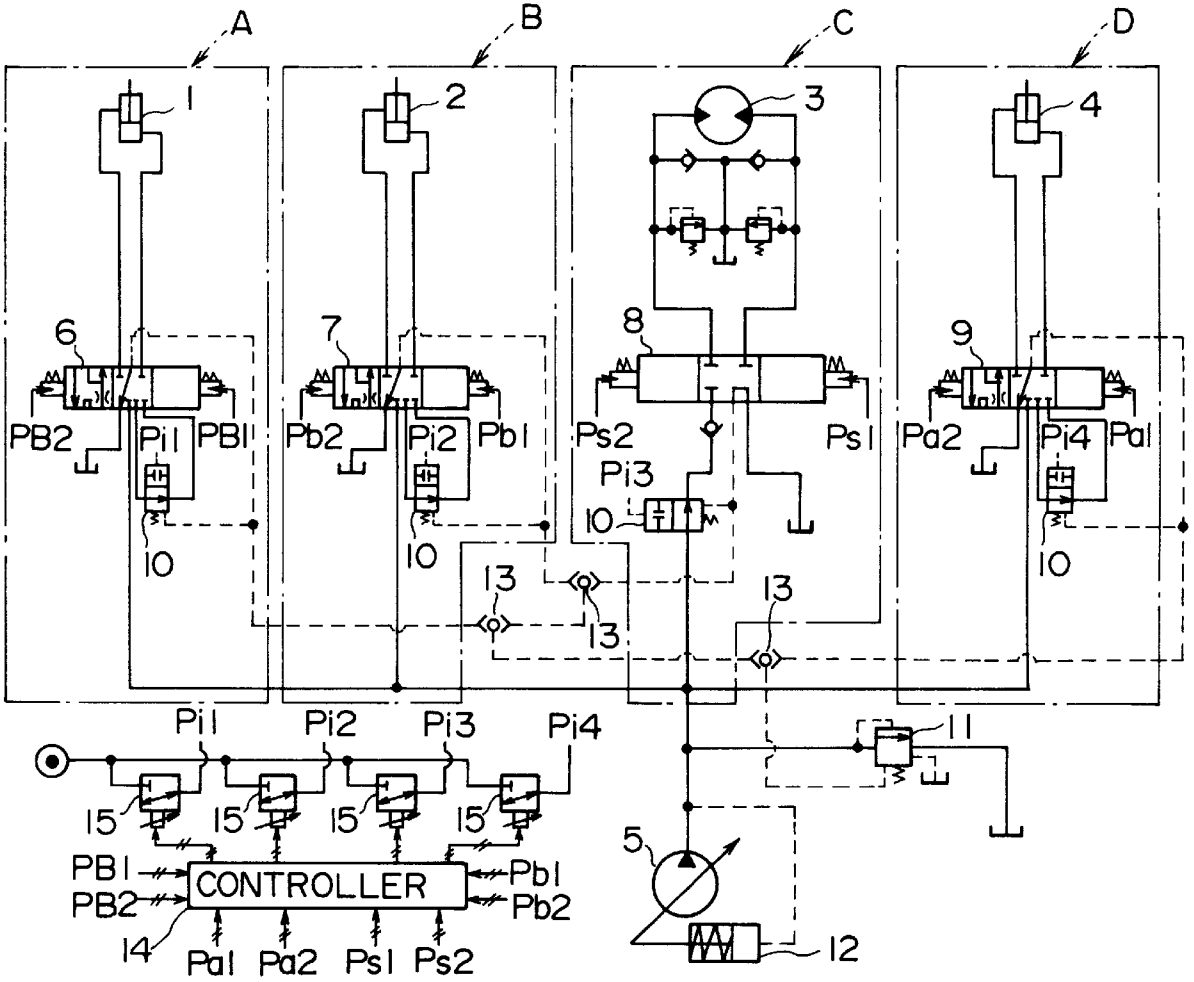
FIG. 4 is a general block diagram showing an example of a prior art hydraulic control apparatus.

In the following embodiments an example of a prior art hydraulic control apparatus applied to a hydraulic excavator will be explained. In the embodiments, the same members as those of the prior art apparatus shown in FIG. 4 are designed by the same reference numerals, and will not be described in order to prevent redundancy.

Figure 1:
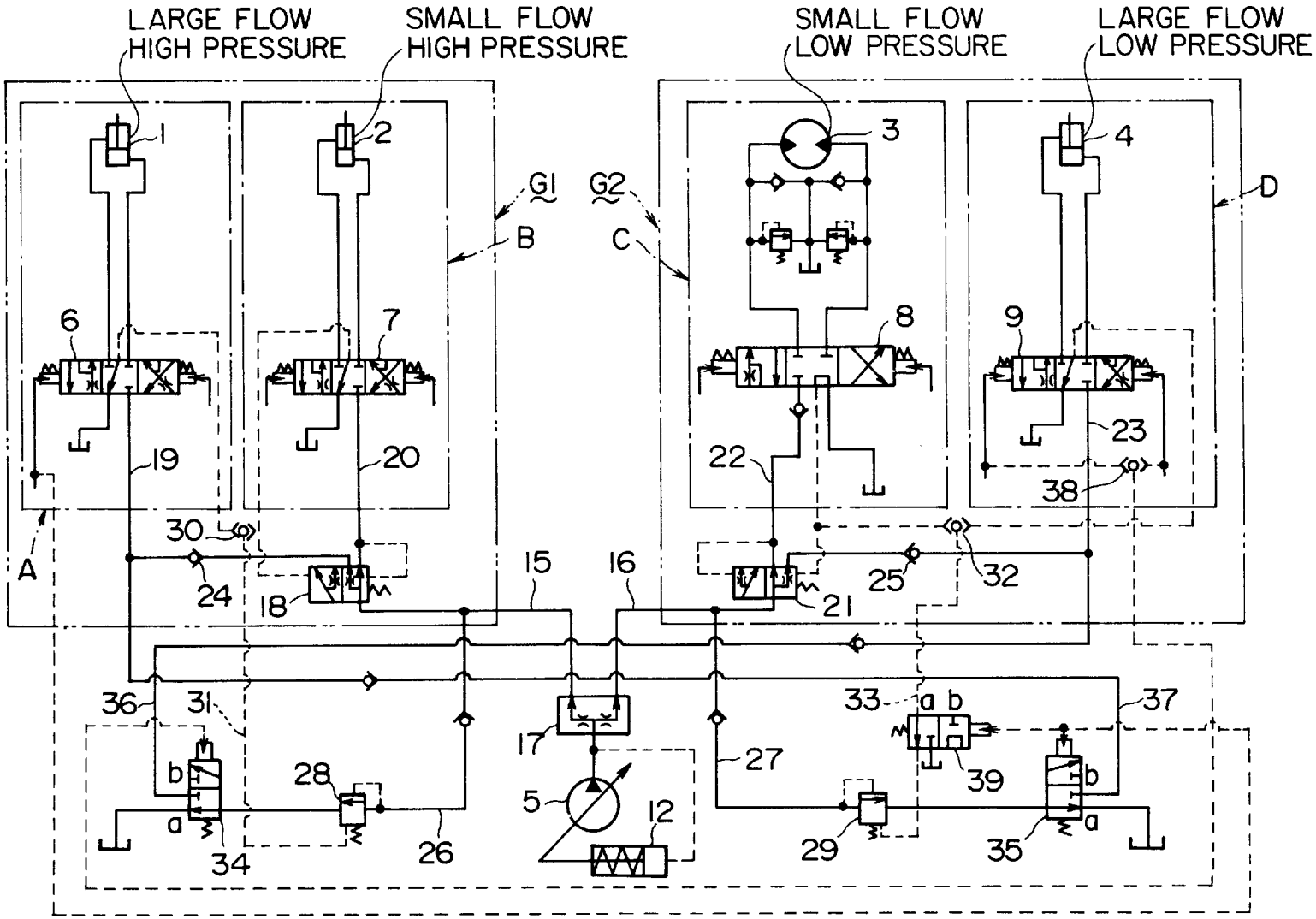
FIG. 1 is a general block diagram showing a first embodiment of the present invention.

First Embodiment (See FIG. 1)

Actuator circuits A, B, C and D are divided into a first group G1 and a second group G2 in accordance with the combination of a circuit requiring the large flow rate and another circuit requiring the small flow rate, that is, the combination of the boom cylinder circuit A and the bucket cylinder circuit B, and the combination of the rotating motor circuit C and the arm cylinder circuit D; the first group G1 is connected to a first pressure line 5, and the second group G2, to a second pressure line 16.

These pressure lines 15 and 16 are connected to the hydraulic pump 5 via a flow divider 17 which divides the flow of the fluid being discharged from the hydraulic pump 5 at the ratio of 1 to 1, thereby supplying the pump delivery fluid equally to the groups G1 and G2 which are independently supplied with the hydraulic pressure.

The first pressure line 15 is connected to hydraulic pressure supply lines 19 and 20 of the boom cylinder circuit A and the bucket cylinder circuit B via a bucket preferential valve 18; and the second pressure line 16 is connected to hydraulic fluid supply lines 22 and 23 of the rotating motor circuit C and the arm cylinder circuit D via a rotating preferential valve 21.

A reference numeral 24 denotes a check valve which allows only the flow of the fluid flowing from the hydraulic fluid supply line 20 for the bucket cylinder to the hydraulic fluid supply line 19 for the boom cylinder; and 25 expresses a check valve which allows only the flow of the fluid flowing from the hydraulic fluid supply line 22 for the rotating motor to the hydraulic pressure supply line 23 for the arm cylinder.

The bucket preferential valve 18 functions to lead the inlet pressure of the bucket cylinder control valve 7 to one pilot chamber and the outlet pressure (bucket cylinder load pressure) to the other pilot chamber, permitting the flow of the fluid of a quantity corresponding to the amount of operation to the hydraulic fluid supply line 20 for the bucket cylinder; the excess fluid is allowed to flow into the hydraulic fluid supply line 19 for the boom cylinder.

The rotating preferential valve 21 functions to lead the inlet pressure of the rotating motor control valve 8 into one pilot chamber and the outlet pressure (rotating motor load pressure) into the other pilot chamber respectively. When the control valve 8 is operated, the fluid of a quantity corresponding to the amount of operation is allowed to flow into the hydraulic fluid supply line 22 for the rotating motor, and the excess fluid is allowed to flow into the hydraulic fluid supply line 23 for the arm cylinder.

That is, both the groups G1 and G2 have the circuit constitution that the fluid is preferentially supplied to the bucket cylinder circuit B and the rotating motor circuit C which are actuator circuits requiring the small flow rate.

In the meantime, unloading lines 26 and 27 for returning the excess fluid to the tank are connected to the first and the second pressure lines 15 and 16.

In both the unloading lines 26 and 27 are inserted pressure-compensating type unloading valves 28 and 29 (hereinafter termed the first unloading valve and the second unloading valve).

To the first unloading valve 28, the pressure on the high pressure side, taken up from the holding pressure (load pressure) at the boom cylinder 1 and the bucket cylinder 2 through a shuttle valve 30 and a holding pressure take-up line 31 and the outlet pressure of the flow divider 17, are applied. The first unloading valve 28 serves to compensate the pressure at the first pressure line 15 over a holding pressure on the high pressure side.

To the second unloading valve 29, the pressure on the high pressure side, taken up from the holding pressure at the rotating motor 3 and the arm cylinder 4 through a shuttle valve 32 and a holding pressure take-up line 33 and the outlet pressure of the flow divider 17, are applied. The pressure at the second pressure line 16 is compensated so as to exceed the holding pressure on the high pressure side by the second unloading valve 29.

Furthermore, to the unloading lines 26 and 27, first and second confluent lines 36 and 37 are branched and connected via a hydraulic pilot type directional control valve 34 for the arm cylinder and a directional control valve 35 for the boom cylinder at the downstream side of the unloading valves 28 and 29. The first confluent line 36 is connected to the hydraulic fluid supply line 23 for the arm cylinder and the second confluent line 37 is connected to hydraulic fluid supply line 19 for the boom cylinder.

The directional control valve 34 for the arm cylinder is designed to be switched from the unload position (a) to a confluence position (b) when the extension-side or contraction-side pilot pressure of the arm cylinder control valve 9 has exceeded a specific value. A reference numeral 38 denotes a shuttle valve which selects the high pressure side from the pilot pressures on both the extension and contraction sides.

In the meantime, the directional control valve 35 for the arm cylinder is switched from the unload position (a) to the confluence position (b) when the extension side pilot pressure of the boom cylinder control valve 6 has exceeded the specific value, thus allowing the confluence of an excess fluid as described below.

(i) The excess fluid flows to the hydraulic fluid supply line 23 for the arm cylinder when the arm cylinder control valve 9 is operated largely to the extension side or to the contraction side (when the arm cylinder circuit D requires a great flow rate; hereinafter this operation is called as the arm second-speed operation) and if the excess fluid is present in the first group G1; and (ii) The excess fluid flows to the hydraulic fluid supply line 19 for the boom cylinder when the boom cylinder control valve 6 is operated largely to the extension side or to the contraction side (when the boom cylinder circuit A requires a great flow rate on the extension side. Hereinafter this operation is called as the boom second-speed operation) and if the excess fluid is present in the second group G2.

Furthermore, a directional control valve 39 for keeping a holding pressure is provided in the holding pressure take-up line 33 of the second unloading valve 29.

The directional control valve 39, operating in connection with the operation of the directional control valve for the boom cylinder, is switched from the holding pressure introducing position (a) where the holding pressure is introduced into the CLOSE side pilot chamber of the second unload valve 29 to the FREE position (b) where the CLOSE SIDE pilot chamber is connected to the tank and the holding pressure is blocked.

With the switching operation of the directional control valve 35 for the boom cylinder and the directional control valve 39 for keeping the holding pressure, the second unloading valve 29 is opened to the FREE position (full-open position) at the time of the operation of the directional control valve for the boom cylinder, and therefore the pressure in the second pressure line 16 becomes equal to the boom load pressure.

Since the pump delivery pressure at the time of combined control of (BOOM UP/ROTATE) is set on the basis of the boom cylinder load pressure and the pump delivery flow rate is determined with reference to the boom cylinder, the required flow rate can not be secured for the boom cylinder 1 like the case that the pump delivery flow rate is set on the basis of a high rotating pressure at the beginning of rotating motion.

In the present embodiment, the two groups G1 and G2 independently supplied with the hydraulic fluid in the respect of pressure are formed by the combination of the actuator circuits requiring the large flow rate (the boom cylinder circuit A and the arm cylinder circuit D) and the actuator circuits requiring the small flow rate (the bucket cylinder circuit B and the rotating motor circuit C) as described above. In these groups G1 and G2 having the above-described circuit constitution, the fluid is preferentially supplied to the bucket cylinder circuit B and the rotating motor circuit C via the bucket preferential valve 18 and the slew preferential valve 21. Therefore the required flow rate for the bucket cylinder 2 is secured at the time of the combined control in the first group G1, and the required flow rate for the rotating motor 3 also is secured at the time of combined control in the second group G2.

It is, therefore, possible to eliminate such a disadvantage that, at the time of the combined control operations, an insufficient flow rate of fluid for the actuators requiring the small flow rate (i.e. the bucket cylinder 2 and the rotating motor 3) is caused by the proportional allocation based on the amount of valve operation, and extremely slow operation of these actuators and adversely affected operation result like in the conventional apparatus.

Figure 2:
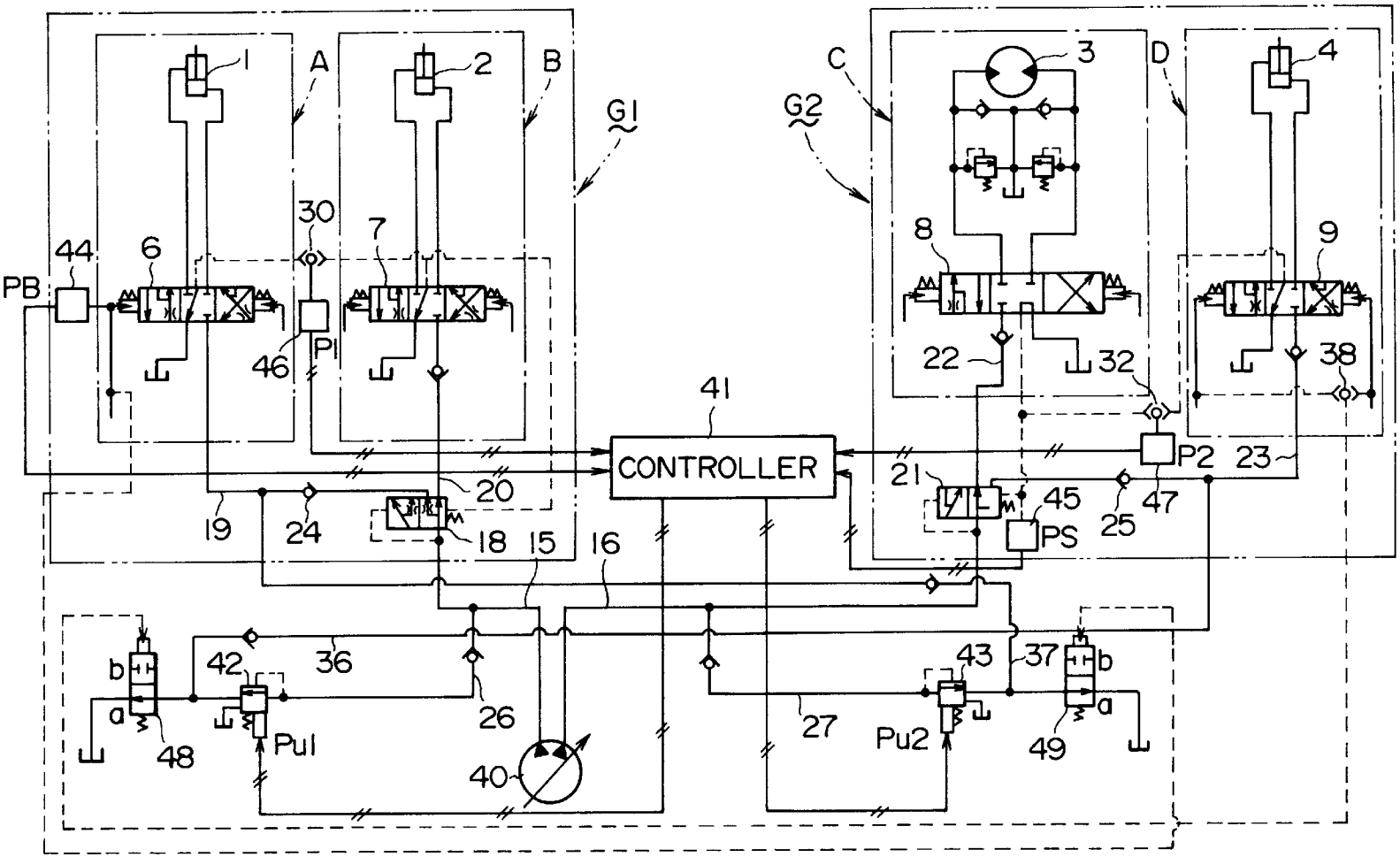
FIG. 2 is a general block diagram showing a second embodiment of the present invention.

Second Embodiment (See FIG. 2)

Hereinafter only differences from the first embodiment will be explained.

① A split-type hydraulic pump 40 which delivers the equal quantity of fluid from two outlets is adopted as a hydraulic pressure source.

It has therefore become possible to dispense with the flow divider 17 of the first embodiment while maintaining the independence of the first and the second groups G1 and G2.

② Solenoid proportional unloading valves 42 and 43 whose set pressure is controlled by a controller 41 are employed as pressure-compensating unloading valves for setting the pressure of the first and the second pressure lines 15 and 16.

Also, the boom extension pilot pressure PB of the boom cylinder control valve 6, the holding pressure PS of the rotating motor 3, the holding pressure on the high pressure side P1 selected by the shuttle valve 30 in the first group G1, and the holding pressure P2 on the high pressure side selected by the shuttle valve 32 in the second group G2 are changed to electric signals by pressure sensors 44, 45, 46, and 47 respectively, and the electric signals are inputted to the controller 41.

The controller 41 computes and outputs the common set pressures Pu1 and Pu2 for the unloading valves 42 and 43 on the basis of the sensor signals PB, PS, P1 and P2 by the following equations:

$$Pu1=P1+\alpha$$

$$Pu2=P2+\alpha$$

Also, the command set pressure Pu2 for the second unloading valve 43 is set to 0 or its approximate value to make the pressure at the second pressure line 16 equal to the boom cylinder pressure.

Because of the above-described constitution that set values are computed and outputted as commands by the controller 41, it is possible to reduce a response delay before gaining the set pressure based on the holding pressure, as compared with the case in which the hydraulic unloading valves 28 and 29 are used as in the first embodiment.

③ On-off valves 48 and 49, which are switched between the unloading position (a) in which the unloading lines 26 and 27 and the tank are connected, and the block position (b) in which the unloading lines 26 and 27 and the tank are disconnected during the second-speed control, are provided instead of the valves for the arm cylinder or the beam cylinder 34, 35. Furthermore, the confluent lines 36 and 37 are branched off from the unloading lines 26 and 27 at the inlet side of the on-off valves 48 and 49 so that the excess fluid will flow into the hydraulic fluid supply line 23 for the arm cylinder and into the hydraulic fluid supply line 19 for the boom cylinder in the block position b.

Figure 3:
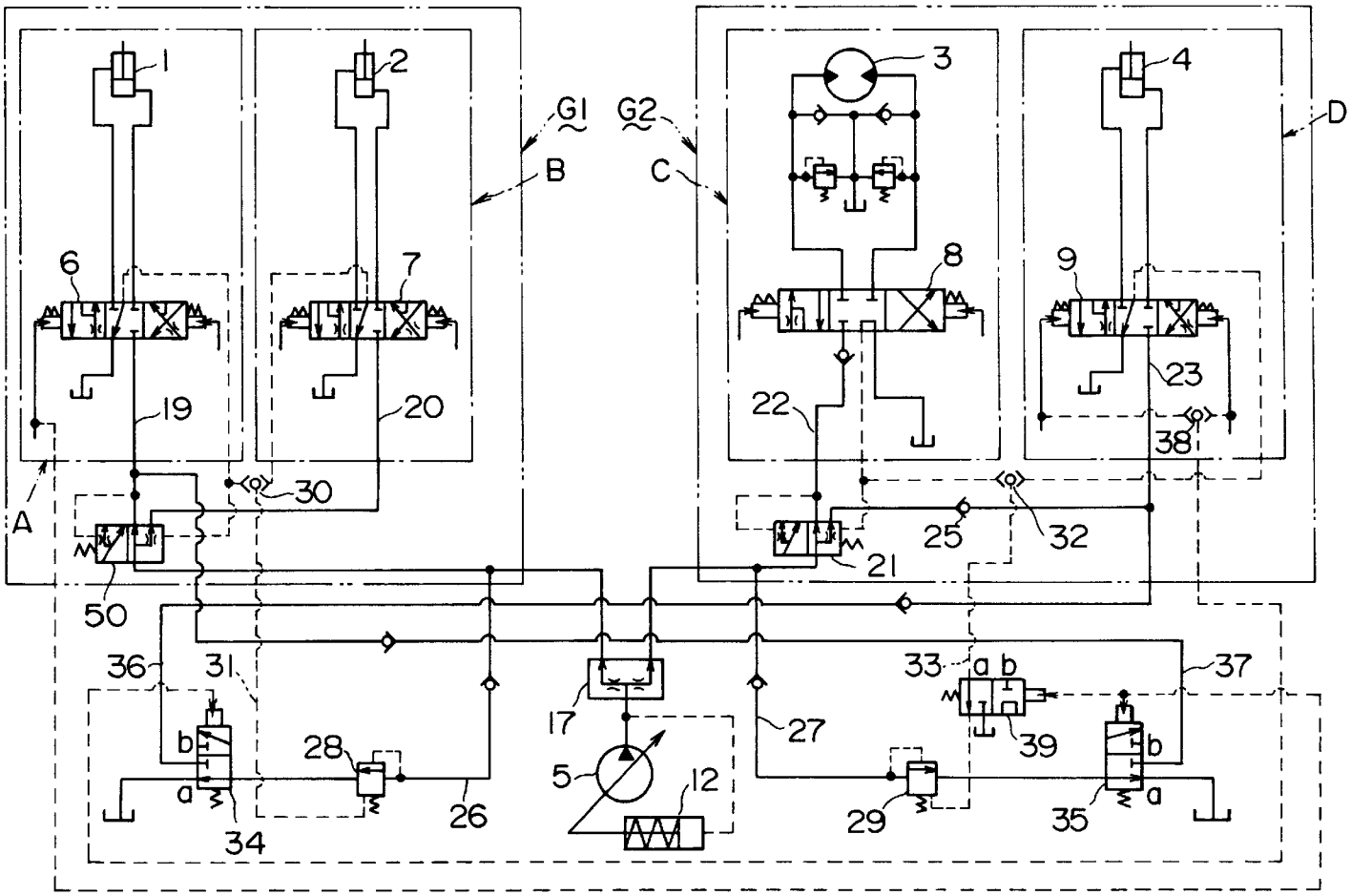
FIG. 3 is a general block diagram showing a third embodiment of the present invention.

Third Embodiment (See FIG. 3)

The third embodiment has the construction that, in both the groups G1 and G2, the fluid is preferentially supplied to the actuator circuit requiring a relatively high pressure.

That is, the first group G1 is provided with a boom preferential valve 50 for supplying the fluid preferentially to the boom cylinder circuit A, while the second group G2, with the rotating preferential valve 21 for supplying the fluid preferentially to the rotating motor circuit C.

Other circuits exemplified have the same construction as the circuits of the first embodiment.

According to the circuit construction, the fluid is reliably supplied at a required flow rate to the rotating motor 3 and to the boom cylinder 1 which is an actuator on the high pressure side where the fluid becomes hard to flow at the time of the combined control in both the groups G1 and G2.

Furthermore, since all the excess fluid flows into the arm cylinder circuit D when the flow rate required by the control of the rotating motor control valve 8 exceeds the flow rate actually absorbed by the rotating motor 3 at the start of rotating motion, no excess fluid wasting will occur like that in the circuit construction in which the excess fluid is all returned to the tank.

In the above-described third embodiment, the construction similar to the first embodiment is employed, while it is possible to employ the construction similar to the second embodiment. Namely, a hydraulic pump having two discharging ports may be used instead of a flow divider 17, and an excess fluid can be controlled by a controller.

It should be noted that the present invention is applicable to hydraulic cranes such as rough terrain cranes.

In this case, the first group should be formed by combining the boom up-down cylinder circuit (the actuator circuit on the large flow rate side) and the boom extension cylinder circuit (the actuator circuit on the small flow rate side), and the second group should be formed by combining a hoist motor circuit (the actuator circuit on the large flow rate side) and the rotating motor circuit (the actuator circuit on the small flow rate side).

According to the present invention described above, two groups supplied with the hydraulic fluid which are independent in the respect of pressure supply are formed by combining the actuator circuit on the large flow rate side (the boom cylinder circuit and the arm cylinder circuit) and the actuator circuit on the small flow rate side (the bucket cylinder circuit and the rotating motor circuit); in these groups the hydraulic fluid is supplied preferentially to the actuator circuit on the small flow rate side. Therefore, at the time of combined control when the gross required flow rate exceeds the pump delivery flow rate, a required flow rate is secured at the actuator on the small flow rate side and also a substantial amount of excess fluid is supplied to the actuator on the large flow rate side, thus enabling to ensure its operation.

Furthermore, when the fluid is demanded by the actuator circuit on the large flow rate side of one group and an excess amount of fluid is present in the other group, the excess fluid is supplied to the actuator circuit on the large flow rate side; therefore it is possible to secure a substantial quantity of fluid at the time of combined control, thus improving combined control performance.

In the meantime, two groups independently supplied with the fluid pressure are formed by combining the actuator circuits on the high pressure side (the boom cylinder circuit and the rotating motor circuit) and the actuator circuits on the low pressure side (the bucket cylinder circuit and the arm cylinder circuit). In these groups, the hydraulic fluid is supplied preferentially to the actuator circuit on the high pressure side and therefore it is possible to reliably operate the actuator on the high pressure side, and at the same time, wasting of the fluid like in the circuit constitution in which all the excess fluid is returned to the tank can be prevented.

According to the constitution of claims 1 to 5 of the present invention, control valve and solenoid proportional valve that are required for geometrically allocating the pump delivery flow rate on the basis of the amount of valve operation can be dispensed with, thereby enabling simplification of the control system constitution and cost reduction, and moreover enabling to supply a proper quantity of fluid to each actuator at the time of combined control.

We claim:

1. A hydraulic control apparatus, comprising:

a hydraulic pressure source;

a first group including a combination of a high-pressure actuator circuit and a low-pressure actuator circuit, wherein one of said high-pressure actuator circuit and said low pressure actuator circuit is a large flow rate actuator circuit and the other of said high-pressure actuator circuit and said low pressure actuator circuit is a small flow rate actuator circuit;

a second group including a combination of said high-pressure actuator circuit and said low-pressure actuator circuit, wherein one of said high-pressure actuator circuit and said low pressure actuator circuit, of said second group, is a large flow rate actuator circuit and the other of said high-pressure actuator circuit and said low pressure actuator circuit, of said second group, is a small flow rate actuator circuit, said second group being fluidically connected to said hydraulic pressure source independently of said first group;

a preferential valve provided in each of said first group and said second group, said preferential valve being designed to supply a pressure fluid preferentially to said high-pressure actuator circuit when said high-pressure actuator circuit and said low-pressure actuator circuit within each group are simultaneously operated;

a tank for receiving excess fluid from said first group and said second group;

an unloading circuit for returning said excess fluid from each of said first group and said second group into said tank; and a confluent line connected to each of said unloading circuits, to supply excess fluid to said large flow rate actuator circuit within each of said first and second groups from the other of said first and second groups in accordance with a demand of said large flow rate actuator circuit within each of said first and second groups.

2. A hydraulic control apparatus according to claim 1, wherein said high-pressure actuator circuit within said first group is a boom cylinder circuit; and said low-pressure actuator circuit within said first group is a bucket cylinder circuit.

3. A hydraulic control apparatus according to claim 1, where said high-pressure actuator circuit within said second group is a rotating motor circuit; and said low-pressure actuator circuit within said second group is an arm cylinder circuit.

4. A hydraulic control apparatus according to claim 1, wherein said high-pressure actuator circuit within said first group is a boom cylinder circuit; said low-pressure actuator circuit within said first group is a bucket cylinder; said high-pressure actuator circuit within said second group is a rotating motor circuit; and said low-pressure actuator circuit within said second group is an arm cylinder circuit.

5. A hydraulic control apparatus according to claim 1, wherein said unloading circuit includes a directional changeover valve for supplying excess fluid to said low-pressure actuator circuit.

6. A hydraulic control apparatus according to claim 1, wherein said unloading circuit is controlled by a controller.

7. A hydraulic control apparatus according to claim 1, wherein said first group and said second group are connected to said hydraulic pressure source through a flow divider.

8. A hydraulic control apparatus according to claim 1, wherein said hydraulic pressure source is a split-type hydraulic pump for discharging an equal amount of fluid from two delivery ports.

* * * * *